US005581940A

United States Patent [19]

Peterson

[11] Patent Number: 5,581,940

[45] Date of Patent: Dec. 10, 1996

[54] DOG DOOR

[75] Inventor: Randall R. Peterson, 210 Circle Dr., Watertown, S. Dak. 57201

[73] Assignee: Randall R. Peterson, Watertown, S. Dak.

[21] Appl. No.: 572,889

[22] Filed: Dec. 18, 1995

[51] Int. Cl.[6] ..... E05D 15/48

[52] U.S. Cl. ..... 49/169; 49/366; 49/371; 49/386

[58] Field of Search ..... 49/169, 168, 380, 49/386, 371, 366, 367; 199/484

[56] References Cited

U.S. PATENT DOCUMENTS

| | | | |
|---|---|---|---|
| 2,839,791 | 6/1958 | Lee | 49/386 X |
| 3,499,246 | 3/1970 | Loukas | 49/169 |
| 3,978,616 | 9/1976 | Pennock | 49/386 |
| 4,043,079 | 8/1977 | Smith | 49/169 X |
| 4,122,630 | 10/1978 | Parisien | 49/386 |
| 4,177,540 | 12/1979 | Gorton | 49/386 X |
| 4,969,292 | 11/1990 | Reid et al. | 49/169 |

*Primary Examiner*—Philip C. Kannan

[57] ABSTRACT

The present invention relates to a two way animal door adapted to be installed in an existing door to allow two way travel of household pets. More specifically, the present invention pertains to a frame which is inserted into a rectangular aperture formed within an existing door. The frame carries a centrally located post which serves to divide the frame into two equal portions. Within the frame are position a first and a second door. The first door is openable only in one direction, while the second door is openable only the opposite direction. Each of the doors is mounted to the surrounding frame by way of adjustable spring biased hinges. The various components of the present invention and the manner in which they interrelate will be described in greater detail hereinafter.

4 Claims, 3 Drawing Sheets

DOG DOOR

BACKGROUND OF THE INVENTION

1. Field of the Invention

The present invention relates to dog door and more particularly pertains to two way dog door.

2. Description of the Prior Art

The use of pet doors is known in the prior art. More specifically, pet doors heretofore devised and utilized for the purpose of permitting pet entrance are known to consist basically of familiar, expected, and obvious structural configurations, notwithstanding the myriad of designs encompassed by the crowded prior art which has been developed for the fulfillment of countless objectives and requirements.

For example, U.S. Pat. No. Des. 267,436 illustrates a design for a pet access door, U.S. Pat. No. 4,216,743 to Cohen discloses a magnetically unlocked pet door. Additionally, U.S. Pat. No. 4,760,872 to Hale, Jr discloses a security pet door and U.S. Pat. No. 5,117,890 to Taylor et al illustrates a pet door.

In this respect, the dog door according to the present invention substantially departs from the conventional concepts and designs of the prior art, and in doing so provides an apparatus primarily developed for the purpose of two way dog door.

Therefore, it can be appreciated that there exists a continuing need for new and improved dog door which can be used for two way dog door. In this regard, the present invention substantially fulfills this need.

SUMMARY OF THE INVENTION

In view of the foregoing disadvantages inherent in the known types of pet doors now present in the prior art, the present invention provides an improved dog door. As such, the general purpose of the present invention, which will be described subsequently in greater detail, is to provide a new and improved dog door and method which has all the advantages of the prior art and none of the disadvantages.

To attain this, the present invention essentially comprises a rectangular frame is approximately 18" tall and 24" wide. Furthermore, the frame is comprised of a front, a back, an outer periphery, an inner periphery. Additionally, frame is constructed from a number of components, namely: an upper member; a lower member; a first side member and a second side member. This rectangular frame is adapted to be inserted within an aperture previously formed within the door. The preferred material for the construction of the frame is wood, specifically fir. However, any material would be sufficient. The stationary center post has an upper portion, a lower portion and an intermediate extent therebetween. The upper portion is adapted to be secured to the inner periphery of the upper member, and the lower portion is adapted to be secured to the inner periphery of the lower member. These securements can be achieved by way of nails or glue. The center post functions to divide the rectangular frame into two equal portions, a first side portion and a second side portion. These two side portions are adapted to receive two doors as will be described in greater detail hereinafter. The first side door has a front, a back and an outer periphery. The first side door is attached to the surrounding frame by way of, in the preferred embodiment, a first and a second adjustable spring loaded hinge. These hinges interconnect the outer periphery of the first side door to the front first side member of the rectangular frame. Thus, these hinges permit the first side door to be opened in only one direction. The second side door is similar in construction to the first side door. Namely, the second side door has a front, a back and an outer periphery. Third and a fourth adjustable spring loaded hinges, in the preferred embodiment, serve to interconnect the outer periphery of the second side door to the back second side member of the rectangular frame. These hinges permit the door to be opened in a sense opposite to the first side door. Thus, the first side door, with its corresponding hinges, permits access from the back to the front of the door. Additionally, the second side door, with its corresponding hinges, permits access from the front to the back of the door. Trim members can be secured to the faces of the existing door to enable the sealing of the frame member within the aperture of the existing door. The front side would include a front side upper trim member, a front side lower trim member, a first side front trim member and a second side front trim member. Each of these trim members would be adapted to be secured about the front side of the frame member. Correspondingly, the back side would include a back side upper trim member, a back side lower trim member, a first side back trim member and a second side back trim member. Again, each trim member would be adapted to be secured about the back side of the frame member.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved dog door which have all the advantages of the prior art pet doors and none of the disadvantages.

It is another object of the present invention to provide new and improved dog door which may be easily and efficiently manufactured and marketed.

It is further object of the present invention to provide new and improved dog door which are of durable and reliable constructions.

An even further object of the present invention is to provide new and improved dog door which are susceptible of a low cost of manufacture with regard to both materials and labor, and which accordingly are then susceptible of low prices of sale to the consuming public, thereby making such dog door economically available to the buying public.

Still yet another object of the present invention is to provide new and improved dog door which provide in the apparatuses and methods of the prior art some of the advantages thereof, while simultaneously overcoming some of the disadvantages normally associated therewith.

Even still another object of the present invention is to two way dog door.

Lastly, it is an object of the present invention to provide new and improved two way animal door adapted to be installed in an existing door to allow two way travel of household pets. More specifically, the present invention pertains to a frame which is inserted into a rectangular aperture formed within an existing door. The frame carries a centrally located post which serves to divide the frame into two equal portions. Within the frame are position a first and a second door. The first door is openable only in one direction, while the second door is openable only the opposite direction. Each of the doors is mounted to the surrounding frame by way of adjustable spring biased hinges. The various components of the present invention and the manner in which they interrelate will be described in greater detail hereinafter.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
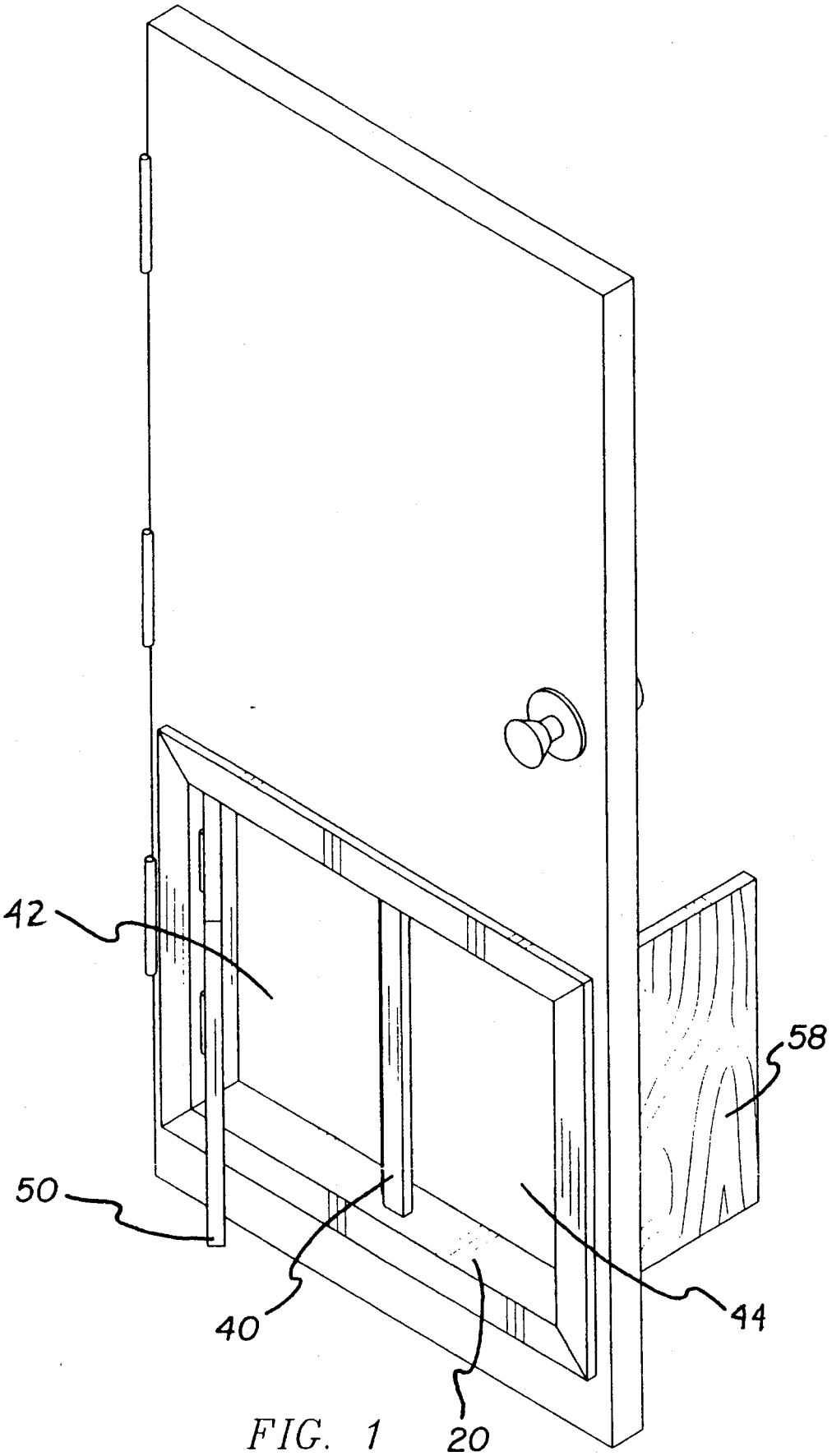
FIG. 1 is a perspective view of the preferred embodiment of the dog door constructed in accordance with the principles of the present invention.
Figure 2:
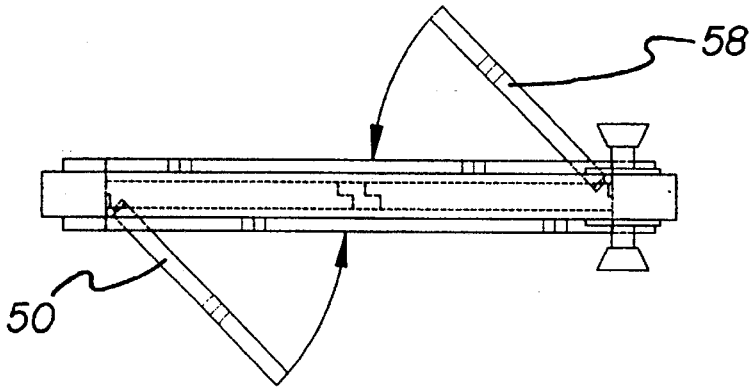
FIG. 2 is a sectional view of the dog door in accordance with the principles of the present invention.
Figure 3:
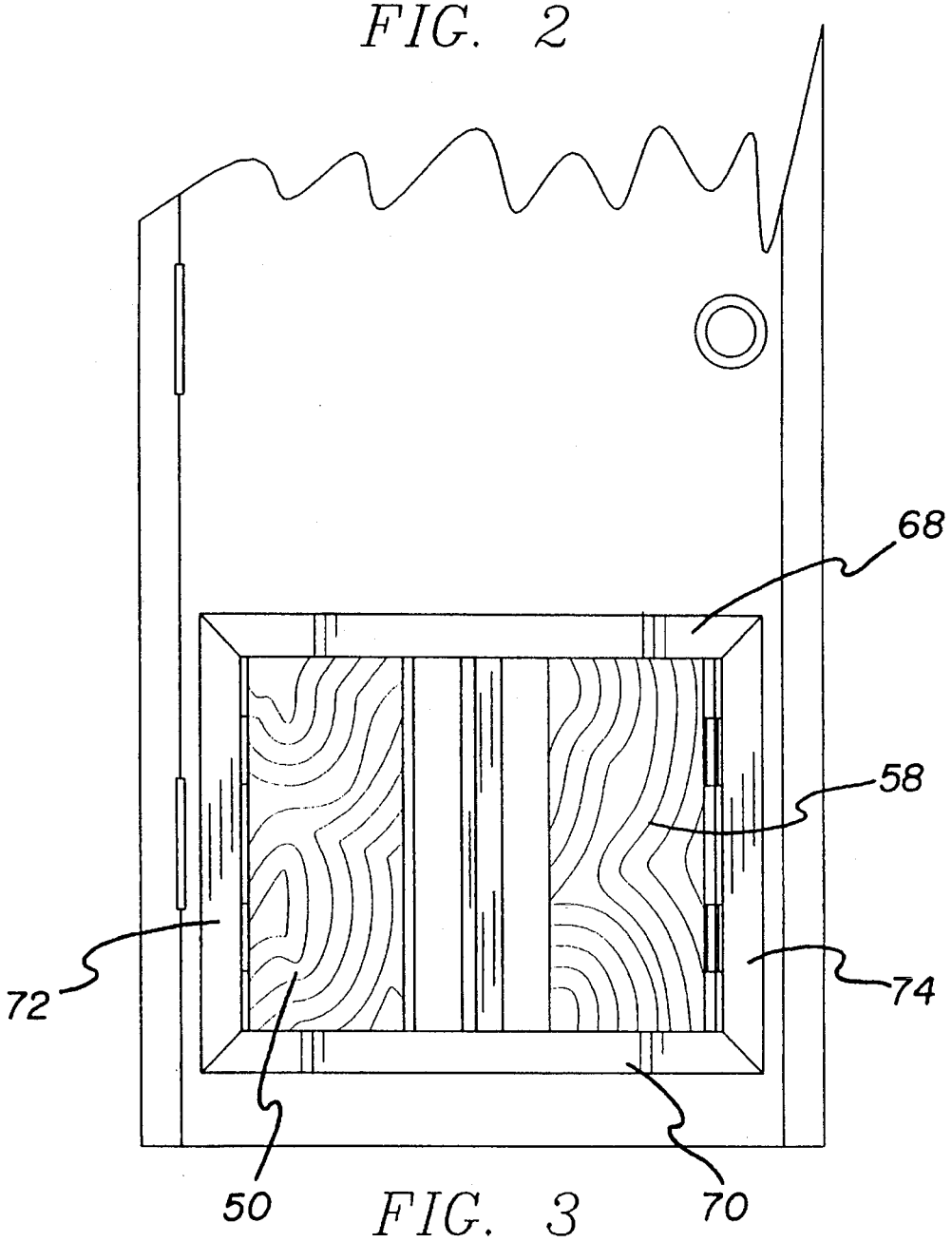
FIG. 3 is a front elevational view of the present invention.
Figure 4:
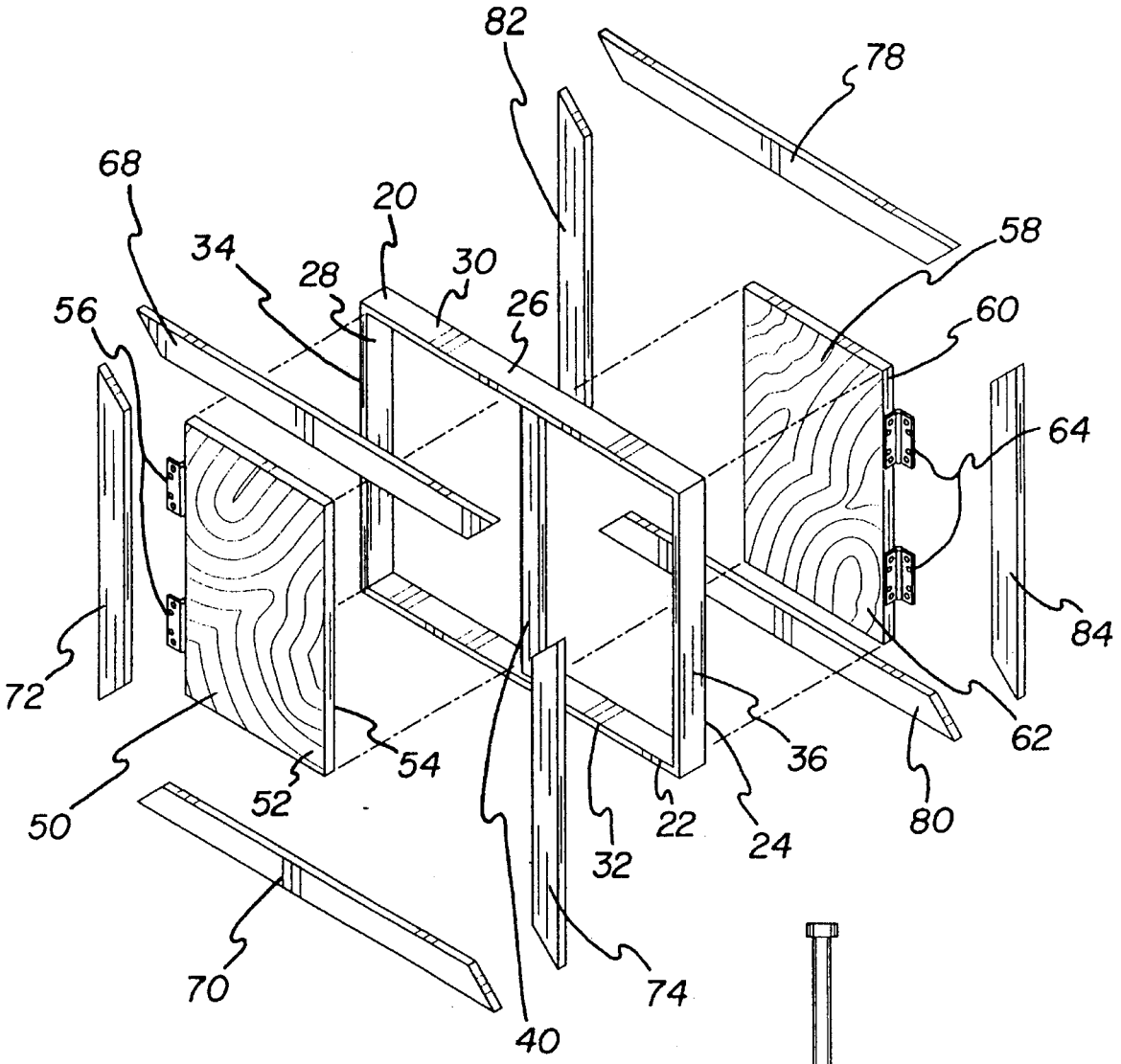
FIG. 4 is an exploded view of the dog door of the present invention.
Figure 5:
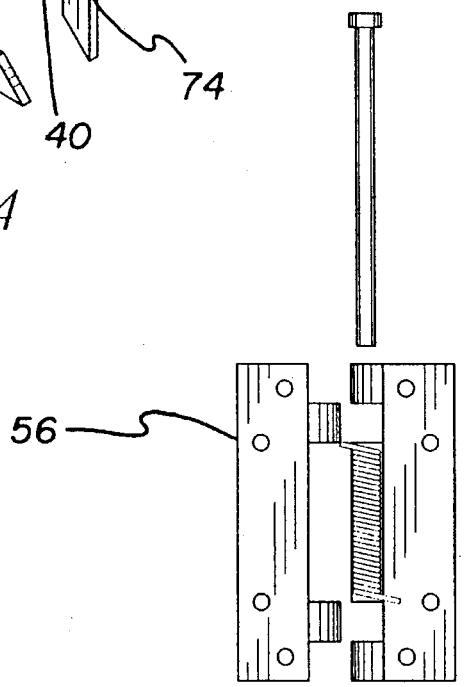
FIG. 5 is a view of one of the spring biased hinges of the present invention.

With reference now to the drawings, and in particular to FIG. 1 thereof, the preferred embodiment of the new and improved dog door embodying the principles and concepts of the present invention and generally designated by the reference numeral 10 will be described.

The present invention relates to a two way animal door adapted to be installed in an existing door to allow two way travel of household pets. More specifically, the present invention pertains to a frame which is inserted into a rectangular aperture formed within an existing door. The frame carries a centrally located post which serves to divide the frame into two equal portions. Within the frame are position a first and a second door. The first door is openable only in one direction, while the second door is openable only the opposite direction. Each of the doors is mounted to the surrounding frame by way of adjustable spring biased hinges. The various components of the present invention and the manner in which they interrelate will be described in greater detail hereinafter.

In the preferred embodiment, the rectangular frame 20 is approximately 18" tall and 24" wide. Furthermore, the frame 20 is comprised of a front 22, a back 24, an outer periphery 26, and an inner periphery 28. Additionally, frame 20 is constructed from a number of components, namely: an upper member 30; a lower member 32; a first side member 34 and a second side member 36. This rectangular frame 20 is adapted to be inserted within an aperture previously formed within the door. The preferred material for the construction of the frame is wood, specifically fir. However, any material would be sufficient.

The stationary center post 40 has an upper portion, a lower portion and an intermediate extent therebetween. The upper portion is adapted to be secured to the inner periphery of the upper member, and the lower portion is adapted to be secured to the inner periphery of the lower member. These securements can be achieved by way of nails or glue. The center post 40 functions to divide the rectangular frame into two equal portions, a first side portion 42 and a second side portion 44. These two side portions are adapted to receive two doors as will be described in greater detail hereinafter.

The first side door 50 has a front 52, a back 54 and an outer periphery. The first side door 50 is attached to the surrounding frame by way of, in the preferred embodiment, first and second adjustable spring loaded hinges 56. These hinges interconnect the front 52 of the first side door 50 to the outer periphery first side member 34 of the rectangular frame 20. Thus, these hinges 56 permit the first side door 50 to be opened in only one direction. The second side door 58 is similar in construction to the first side door. Namely, the second side door has a front 60, a back 62 and an outer periphery. Third and fourth adjustable spring loaded hinges 64, in the preferred embodiment, serve to interconnect the outer periphery 62 of the second side door 58 to the back second side member 36 of the rectangular frame. These hinges permit the door to be opened in a sense opposite to the first side door. Thus, the first side door, with its corresponding hinges, permits access from the back to the front of the door. Additionally, the second side door, with its corresponding hinges, permits access from the front to the back of the door.

Trim members can be secured to the faces of the existing door to enable the sealing of the frame member within the aperture of the existing door. The front side would include a front side upper trim member 68, a front side lower trim member 70, a first side front trim member 72 and a second side front trim member 74. Each of these trim members would be adapted to be secured about the front side of the frame member 20. Correspondingly, the back side would include a back side upper trim member 78, a back side lower trim member 80, a first side back trim member 82 and a second side back trim member 84. Again, each trim member would be adapted to be secured about the back side of the frame member.

Thus, what has been described is a double-sided, windproof hinged dog door to be inserted into the door of a home to provide a means of entrance/exit for a pet. This unit consists of a fir frame approximately 24" wide by 18" high. Inside the frame are two ½" plywood doors of equal size separated by a stationary center post. Both doors have their hinges mounted on their outer periphery's, but each door will open in opposite directions only due to the restrictions placed on them by the center post. When mounted, the doors are flush with the frame and have stops all the way around for weatherproofing. Plastic trim is used for finishing. The entire unit comes pre-assembled. For installation, cut an opening in the door you want your dog to use. It should be approximately 3" from the bottom of the door, large enough to fit the 24"×18" size, and centered. Place the entire unit in the door and screw it in place. Adjust the hinges to fit your dog's size. Keep the hinges loose until the dog is used to them. Train you dog to enter through the in door and exit through the out door. Many homeowners have tried to fashion their own dog doors, but they often detract from the beautyof a home and let in cold air. This unit provides a solution that in not only easy to install, but also airtight. It can be put in just like a pre-hung door. The finishing trim makes it attractive. Adjustable hinges ensure that dogs of any size can use it. Stops on the doors prevent cold air from getting in.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A two way animal door adapted to be installed in an existing door, the two way animal door comprising in combination:

a rectangular frame being approximately 18" tall and 24" wide, the frame having a front, a back, an outer periphery, an inner periphery, an upper member, a lower member, a first side member and a second side member, the rectangular frame adapted to be inserted within an existing door;

a stationary center post having an upper portion, a lower portion and an intermediate extent therebetween, the upper portion secured to the inner periphery of the upper member, the lower portion secured to the inner periphery of the lower member, the center post dividing the rectangular frame into two equal portions, a first side portion and a second side portion;

a first side door having a front, a back and an outer periphery, a first and a second adjustable spring loaded hinge interconnecting the outer periphery of the first side door to the front first side member of the rectangular frame;

a second side door having a front, a back and an outer periphery, a third and a fourth adjustable spring loaded hinge interconnecting the outer periphery of the second side door to the back second side member of the rectangular frame;

a front side upper trim member, a front side lower trim member, a first side front trim member and a second side front trim member, each trim member secured about the front side of the frame member;

a back side upper trim member, a back side lower trim member, a first side back trim member and a second side back trim member, each trim member secured about the back side of the frame member.

2. A two way animal door adapted to be installed in an existing door, the two way animal door comprising in combination:

a rectangular frame having a front, a back, an outer periphery, an inner periphery, an upper member, a lower member, a first side member and a second side member, the rectangular frame adapted to be inserted within an existing door;

a stationary post having an upper portion, a lower portion and an intermediate extent therebetween, the upper portion secured to the inner periphery of the upper member, the lower portion secured to the inner periphery of the lower member;

a first side door having a front, a back and an outer periphery, spring loaded hinge means interconnecting the outer periphery of the first side door to the front first side member of the rectangular frame;

a second side door having a front, a back and an outer periphery, spring loaded hinge means interconnecting the outer periphery of the second side door to the back second side member of the rectangular frame.

3. The two way animal door as described in claim 2 wherein:

the stationary post divides the frame member into two equal portions.

4. The two way animal door as described in claim 2 further including:

a front side upper trim member, a front side lower trim member, a first side front trim member and a second side front trim member, each trim member secured about the front side of the frame member;

a back side upper trim member, a back side lower trim member, a first side back trim member and a second side back trim member, each trim member secured about the back side of the frame member.

* * * * *